US009551971B2

(12) United States Patent
Tsuji et al.

(10) Patent No.: US 9,551,971 B2
(45) Date of Patent: Jan. 24, 2017

(54) SHEET STORAGE APPARATUS AND IMAGE FORMING APPARATUS

(71) Applicant: CANON KABUSHIKI KAISHA, Tokyo (JP)

(72) Inventors: Hiroharu Tsuji, Numazu (JP); Masayoshi Fukatsu, Suntou-gun (JP); Yohei Suzuki, Mishima (JP); Daisuke Kaneko, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/683,680

(22) Filed: Apr. 10, 2015

(65) Prior Publication Data

US 2015/0291375 A1 Oct. 15, 2015

(30) Foreign Application Priority Data

Apr. 14, 2014 (JP) ..... 2014-083186

(51) Int. Cl.

| | |
|---|---|
| ***B65H 31/02*** | (2006.01) |
| ***G03G 15/00*** | (2006.01) |
| ***B65H 31/24*** | (2006.01) |
| ***B65H 31/30*** | (2006.01) |

(52) U.S. Cl.

CPC ..... *G03G 15/6552* (2013.01); *B65H 31/02* (2013.01); *B65H 31/24* (2013.01); *B65H 31/3081* (2013.01); *G03G 15/6538* (2013.01); *B65H 2220/01* (2013.01); *B65H 2301/4212* (2013.01); *B65H 2301/4213* (2013.01); *B65H 2402/443* (2013.01); *B65H 2405/332* (2013.01); *B65H 2408/111* (2013.01); *B65H 2511/412* (2013.01); *B65H 2511/51* (2013.01); *B65H 2511/515* (2013.01); *B65H 2513/42* (2013.01); *B65H 2553/612* (2013.01); *B65H 2601/421* (2013.01); *B65H 2801/12* (2013.01); *G03G 15/50* (2013.01); *G03G 2215/00911* (2013.01)

(58) Field of Classification Search

CPC ..... B65H 2553/00; B65H 31/00; B65H 39/07; B65H 39/11; B65H 2405/10; B65H 2405/11; B65H 2405/3321; B65H 2405/3322; B65H 7/02; B65H 1/28

See application file for complete search history.

(56) References Cited

U.S. PATENT DOCUMENTS

| | | | | |
|---|---|---|---|---|
| 4,068,837 A * | 1/1978 | Lamos | B65H 29/44 | 271/180 |
| 4,214,746 A * | 7/1980 | Redding | B65H 39/11 | 271/293 |
| 4,322,069 A * | 3/1982 | Mitchell | B65H 29/14 | 271/200 |
| 5,033,731 A * | 7/1991 | Looney | B65H 43/08 | 271/176 |
| 5,618,038 A * | 4/1997 | Hutson | B65H 29/14 | 271/220 |

FOREIGN PATENT DOCUMENTS

JP 2013-220905 A 10/2013

* cited by examiner

*Primary Examiner* — Jeremy R Severson

(74) *Attorney, Agent, or Firm* — Canon U.S.A. Inc., IP Division

(57) ABSTRACT

Provided is a sheet storage apparatus for storing a sheet conveyed by a sheet conveyance unit, wherein at a home position, at least a part of a sheet presence detection flag overlaps a rotational axis of a sheet presence detection flag of an adjacent sheet storage unit in a vertical direction.

14 Claims, 9 Drawing Sheets

SHEET STORAGE APPARATUS AND IMAGE FORMING APPARATUS

BACKGROUND OF THE INVENTION

Field of the Invention

The present invention relates to a sheet storage apparatus, and an image forming apparatus including the sheet storage apparatus.

Description of the Related Art

Conventionally, there has been an image forming apparatus such as a copying machine that can temporarily store a sheet on which an image has been formed (hereinafter, referred to as "image-formed sheet") in a sheet storage unit, and discharges the stored sheet so that a user can receive the sheet by an operation (e.g., button operation or identification (ID) authentication).

Japanese Patent Application Laid-Open No. 2013-220905 discusses a sheet storage apparatus capable of relieving a user of time and labor of searching for and receiving the user's own sheet (job) from a discharge tray on which sheets (jobs) printed by a plurality of users are stacked (in mixed manner). In other words, the sheet storage apparatus discussed in Japanese Patent Application Laid-Open No. 2013-220905 is advantageous in that the user can easily receive the user's own printed job.

In a sheet storage apparatus discussed in Japanese Patent Application Laid-Open No. 2013-220905, to restrain enlargement of an image forming apparatus while securing a sufficient storage area in a sheet storage unit, reduction in size in a height direction of the sheet storage unit is necessary.

SUMMARY OF THE INVENTION

The present invention is directed to a sheet storage apparatus and an image forming apparatus capable of reducing the size of the sheet storage apparatus including a sheet storage unit in a height direction.

According to an aspect of the present invention, a sheet storage apparatus for storing a sheet conveyed by a sheet conveyance unit includes a plurality of sheet storage units vertically stacked at a plurality of stages, a lower guide disposed in each of the plurality of sheet storage units and configured to guide a lower surface of the conveyed sheet, an upper guide disposed in each of the plurality of sheet storage units and configured to guide an upper surface of the conveyed sheet, a rotary member disposed in each of the plurality of sheet storage units and in one of the lower guide and the upper guide, and configured to be rotatable by contacting a sheet stored in a sheet storage unit from a home position around a rotational axis extending in a direction orthogonal to a sheet conveying direction, a sensor disposed in each of the plurality of sheet storage units and configured to output a signal according to a position of the rotary member, and a control unit configured to detect presence of a sheet in the sheet storage unit according to an output of the sensor, wherein at the home position, at least a part of the rotary member overlaps a rotational axis of a rotary member of an adjacent sheet storage unit in a vertical direction Further features of the present invention will become apparent from the following description of exemplary embodiments with reference to the attached drawings.

DESCRIPTION OF THE EMBODIMENTS

Hereinafter, exemplary embodiments of the present invention will be described with reference to the drawings.

Figure 1A:
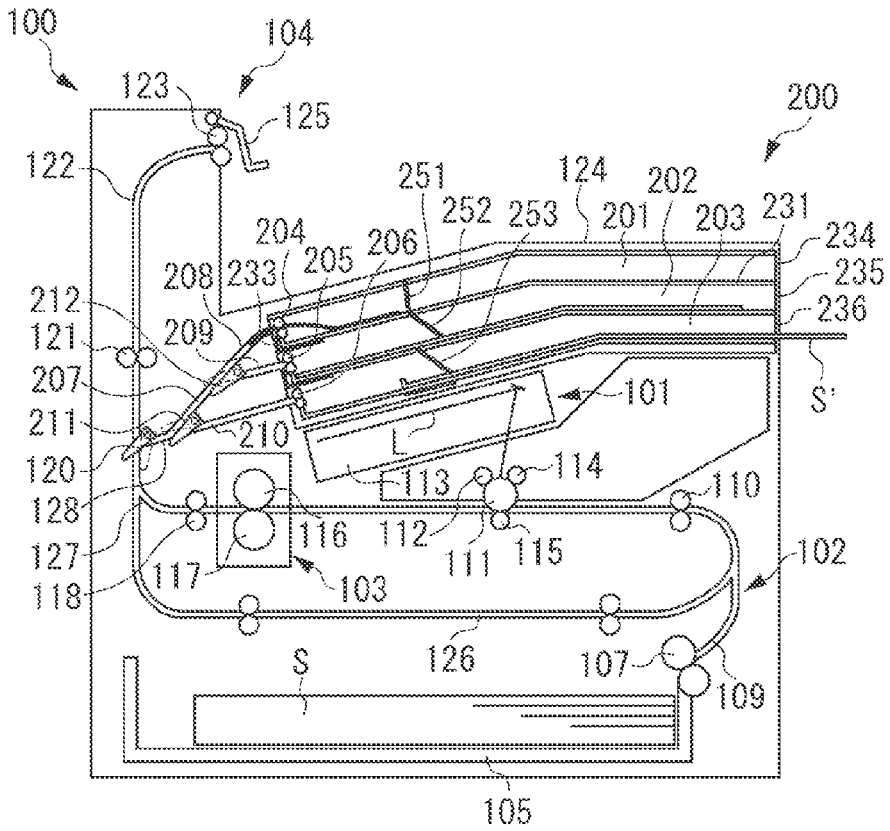
FIGS. 1A and 1B are diagrams illustrating an image forming apparatus according to a first exemplary embodiment of the present invention.
Figure 1B:
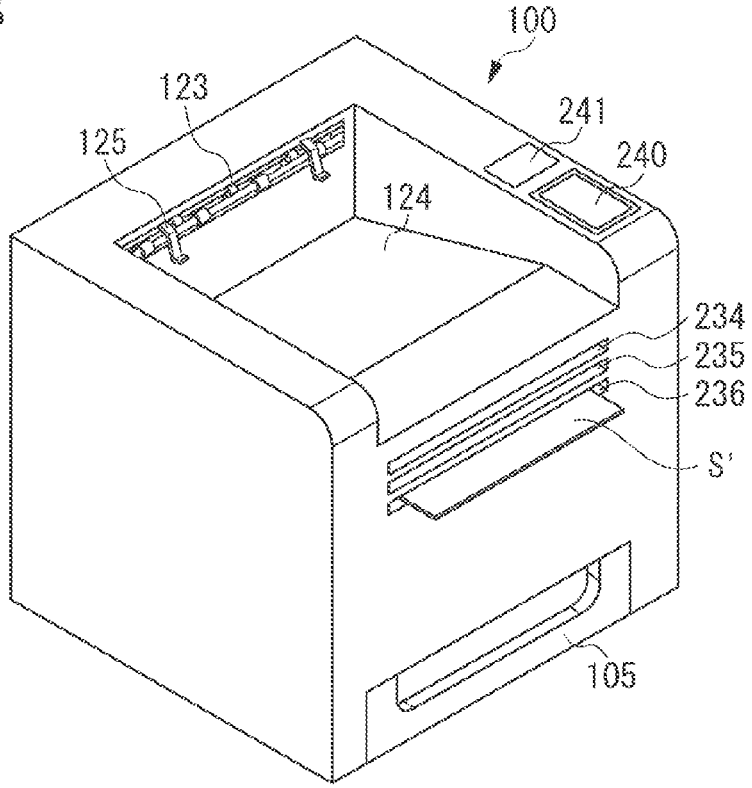

FIG. 1A is a schematic sectional view illustrating a monochrome digital printer as an example of an image forming apparatus according to a first exemplary embodiment of the present invention. FIG. 1B is a perspective view illustrating the monochrome digital printer.

In FIGS. 1A and 1B, an image forming apparatus main body (hereinafter, referred to as apparatus main body) 100 includes a sheet feeding unit 102 configured to feed a sheet, and an image forming unit 101 configured to form an image on the fed sheet. The image formed on the sheet is fixed on the sheet by a fixing unit 103.

A stacking unit 124, which is disposed on an upper surface of the apparatus main body, stacks the sheet on which the image has been formed by the image forming unit 101. Sheet storage units 201, 202, and 203 configured to store the sheet on which the image has been formed by the image forming unit 101 are arranged between the image forming unit 101 and the stacking unit 124.

The image forming unit 101 includes a photosensitive drum 111 that can be rotated clockwise in FIG. 1A, an exposure device, and a charging roller 112, a developing device 114, and a transfer roller 115 arranged substantially sequentially along a rotational direction of the photosensitive drum 111. The image forming apparatus 101 forms a toner image on a sheet S through an image forming process.

The sheet feeding unit 102 includes a feeding cassette 105 for storing a plurality of sheets S to be supplied for image formation in a stacked state, a feeding roller 107, a conveyance guide 109, and a registration roller 110. The fixing unit 103 includes a fixing roller 116, and a pressure roller 117 abutted on the fixing roller 116 from below. A conveyance roller 118 is disposed on the downstream side of the fixing unit 103.

A reconveyance path 126 of the sheet S is disposed between the image forming unit 101, the fixing unit 103, and the feeding cassette 105. The reconveyance path 126 is used for forming images on both front and rear surfaces of the sheet S.

When images are formed on both surfaces of the sheet, the sheet having a toner image formed on one surface (front surface) is conveyed toward a reversing roller 123. A conveyance roller 121 and the reversing roller 123, which are provided to be rotatable normally and reversely, convey the sheet to the stacking unit 124 when rotated normally, and convey the sheet again to the image forming unit 101 when rotated reversely. After a trailing end of the sheet has exited from a branch portion 127, the conveyance roller 121 and the reversing roller 123 are rotated reversely to switch back the sheet. Then, the sheet passes through the reconveyance path 126 to be conveyed to the image forming unit 101.

In the image forming apparatus according to the present exemplary embodiment, a plurality of stages of sheet storage units is vertically stacked, which are a first sheet storage unit 201, a second sheet storage unit 202, and a third sheet storage unit 203 in this order from the top.

A conveyance roller 204 serves as a sheet conveyance unit configured to convey the image-formed sheet to the first sheet storage unit 201. Similarly, a conveyance roller 205 conveys the sheet to the second sheet storage unit 202, and a conveyance roller 206 conveys the sheet to the third sheet storage unit 203.

A first conveyance path switching member 120 can be switched between a first position indicated by a solid line in FIG. 1A for feeding the image-formed sheet to the sheet storage unit and a second position indicated by a broken line for discharging the sheet to the stacking unit 124. The first conveyance path switching member 120 is configured to be switched by an actuator (not illustrated) between the position indicated by the solid line and the position indicated by the broken line illustrated in FIG. 1A.

When the sheet is discharged to the staking unit 124, the first conveyance path switching member 120 is switched to the position indicated by the broken line. The sheet is conveyed along a discharging guide 122 by the conveyance roller 121, and discharged to the stacking unit 124 by the reversing roller 123. As illustrated in FIGS. 1A and 1B, the stacking unit 124, which is disposed on the upper surface of the apparatus main body, can be shared by a plurality of users.

A full-stack detection sensor lever 125 detects a full-stack state of sheets stacked on the stacking unit 124. When the full-stack detection sensor lever 125 detects a full-stack state of sheets, a control unit performs control not to form any images on a sheet until the sheets are removed from the stacking unit 124.

When the sheet is conveyed to the sheet storage unit, the first conveyance path switching member 120 is switched to the position indicated by the solid line. The sheet is conveyed through a conveyance path 128 to a sheet storage apparatus 200.

A second switching member 211 and a third switching member 212 are provided for switching a path through which the sheet is conveyed. Each of the second switching member 211 and the third switching member 212 is configured to be switched between a position indicated by the solid line and a position indicated by the broken line illustrated in FIG. 1A by the actuator (not illustrated).

When the sheet S is conveyed to the first sheet storage unit 201, the second switching member 211 and the third switching member 212 are respectively switched to the positions indicated by the solid line illustrated in FIG. 1A, and held at the switched positions. The image-formed sheet is sequentially passed through the conveyance path 128 and conveyance guides 207 and 208, and conveyed to the first sheet storage unit 201 by the conveyance roller 204.

When the sheet S is conveyed to the second sheet storage unit 202, the second switching member 211 and the third switching member 212 are respectively switched to the position indicated by the solid line and the position indicated by the broken line illustrated in FIG. 1A, and held at the switched positions. The image-formed sheet has sequentially passed through the conveyance path 128 and the conveyance guide 207 and a conveyance guide 209, and is conveyed to the second sheet storage unit 202 by the conveyance roller 205.

When the sheet S is conveyed to the third sheet storage unit 203, the second switching member 211 is switched to the position indicated by the broken line illustrated in FIG. 1A, and held at the switched position. The image-formed sheet has sequentially passed through the conveyance path 128 and a conveyance guide 210, and is conveyed to the third sheet storage unit 203 by the conveyance roller 206.

Next, a configuration of each sheet storage unit will be described in detail. In the image forming apparatus according to the present exemplary embodiment, the plurality of stages of sheet storage units is vertically stacked. The sheet storage units are similar in configuration, and thus the configuration of the first sheet storage unit 201 will be mainly described.

The sheet conveyed to the first sheet storage unit 201 by the conveyance roller 204 is temporarily stacked on a stacking surface 231 to be stored. Whether a sheet is stacked on the stacking surface 231 is detected by a sheet presence detection unit. The sheet presence detection unit includes a sheet presence detection flag 251 and a sensor. A configuration of the sheet presence detection unit will be described in detail below. An extrusion unit 233 extrudes a conveying-direction upstream end (trailing end) of the stored sheet to expose a part of a conveying-direction downstream end (leading end) of the stored sheet to outside of the apparatus main body 100 from a discharge opening 234.

Figure 2A:
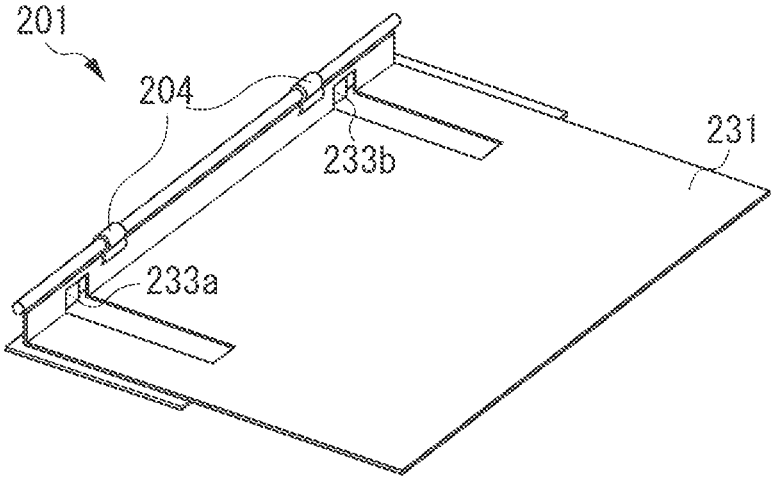
FIGS. 2A and 2B are diagrams illustrating a configuration of a sheet storage unit according to the first exemplary embodiment of the present invention.
Figure 2B:
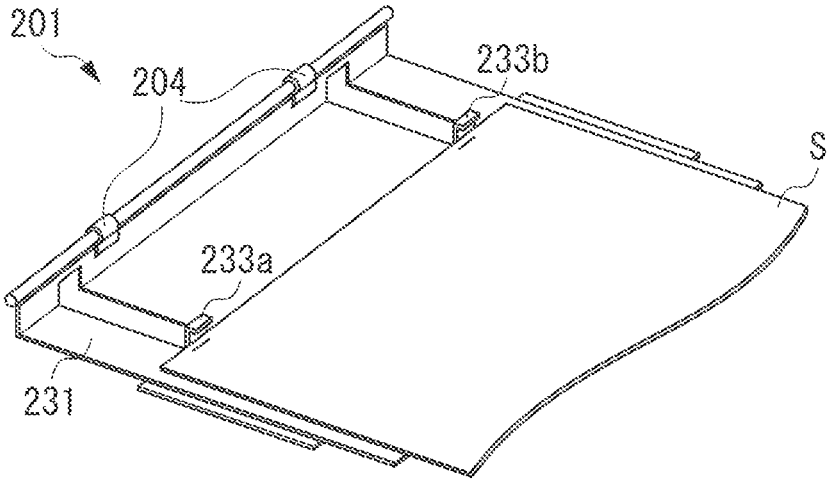

FIGS. 2A and 2B are perspective views illustrating the extrusion unit 233. FIG. 2A illustrates a case where the extrusion unit 233 is at a position (retracting position) not interfering with sheet stacking in the sheet storage unit. FIG. 2B illustrates a case where the extrusion unit 233 is at a sheet discharging position when the stored sheet is exposed to the outside of the apparatus main body 100. The extrusion unit 233 includes two sheet trailing end pressing claws 233*a* and 233*b* along a sheet width direction to prevent rotation of the sheet S during the sheet discharging. When the sheet is extruded, the sheet trailing end pressing claws 233*a* and 233*b* press the upstream end of the sheet S to discharge the sheet S. The extrusion unit 233, which is connected to an actuator 239 (illustrated in FIG. 3), is reciprocated in a sheet discharging direction between the sheet retracting position and the sheet discharging position by the actuator 239 driven to rotate normally and reversely.

A state where the sheet S' has thus been extruded to the discharge opening by the sheet extrusion unit 233 is illustrated as a state of the sheet storage unit 203 in FIGS. 1A and 1B. A part of the stored sheet is extruded from each of discharge openings 234 to 236. Accordingly, the user can receive the user's own job sheet by picking the leading end of the extruded sheet to remove the sheet.

Figure 3:
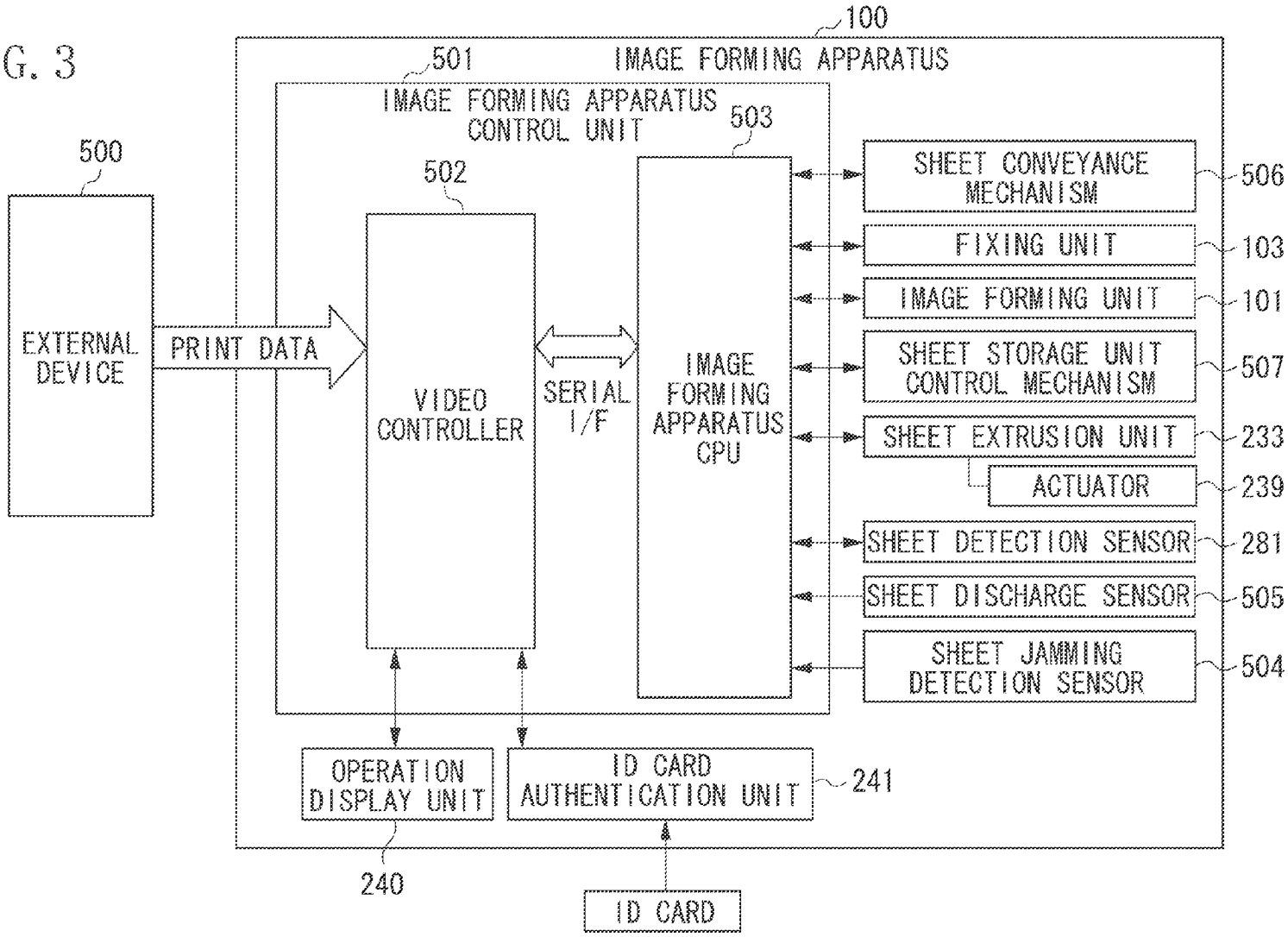
FIG. 3 is a block diagram illustrating the image forming apparatus according to an exemplary embodiment of the present invention.

FIG. 3 is a block diagram illustrating the control unit and a function configuration of the image forming apparatus illustrated in FIGS. 1A and 1B and FIGS. 2A and 2B. The image forming apparatus 100 includes an image forming apparatus control unit 501 as a control unit. The image forming apparatus control unit 501 includes a video controller 502 and an image forming apparatus central processing unit (CPU) 503. The video controller 502 communicates with an external device 500 such as a host computer to receive print data (including control information such as code data based on a predetermined programming language, or image data). The video controller 502 designates printing conditions (discharge opening or the like) created based on the print data and issues a print instruction to the image forming apparatus CPU 503 via a serial interface (I/F). The video controller 502 instructs the image forming apparatus CPU 503 to discharge sheets from the sheet storage apparatus 200 based on user information input from an operation display unit 240 or user information obtained from an ID card by an ID card authentication unit 241.

The image forming apparatus CPU 503 controls printing according to the printing conditions received from the video controller 502. In addition, the image forming apparatus CPU 503 detects an error such as jamming at the image forming apparatus 100 based on information from a jam detection sensor 504 to notify the video controller 502 of the detection result. The image forming apparatus CPU 503 controls a sheet conveyance mechanism 506 to perform a sheet feeding or discharging operation, and controls the image forming unit 101 and the fixing unit 103 to perform an image forming operation and a fixing operation. The image forming apparatus CPU 503 controls a sheet storage unit control mechanism 507 including the conveyance rollers 204 to 206 to convey the image-formed sheet to the sheet storage unit. The image forming apparatus CPU 503 controls, according to an instruction from the video controller 502, the sheet extrusion unit 233 to control discharging of the sheet stored in the sheet storage unit by using information of a connected sheet discharge sensor 505.

Referring back to FIGS. 1A and 1B, the operation of the sheet storage unit will be described. When issuing a printing instruction to the apparatus main body 100 from the external device 500, the user can select on the external device 500 discharging the sheet to the stacking unit 124 or storing the sheet temporarily in the sheet storage unit.

When the user selects storing the sheet in the sheet storage unit, the control unit 501 searches, based on a detection result of the sheet presence detection unit disposed in each sheet storage unit, for a sheet storage unit where no sheet has been stored to determine a sheet conveyance destination.

For example, when the sheet conveyance destination is determined to be the first sheet storage unit 201, each of the switching members is switched as described above to convey the sheet onto the stacking surface 231 of the first sheet storage unit 201.

Since the control unit 501 has information about whose job has been stored in which sheet storage unit, the control unit 501 can designate a sheet storage unit that has already stored the user's sheet as a storage destination if a job is the same user's. The user is not required to designate which sheet storage unit stores the user's job. The sheet is automatically stored in an empty sheet storage unit each time the user's sheet is discharged.

The sheet stored in each sheet storage unit cannot be taken out from the outside of the apparatus main body. The sheet stored in the sheet storage unit is extruded by the extrusion unit according to a user's discharging instruction, and a discharging operation is started. The discharging instruction is issued by pressing a discharging operation start button at the operation display unit disposed in the apparatus main body, ID card authentication, or issuance of a discharging operation start command on the external device connected to the image forming apparatus. A specific method for issuing the discharging operation start command issued from the operation display unit is as follows. For example, a name or a personal ID number of a user having the user's job stored in the sheet storage unit is displayed on the operation display unit 240 disposed in the apparatus main body 100, and a discharging instruction can be issued by operating a portion corresponding to the user. When user authentication is performed by using an ID card, the ID card authentication unit 241 is attached to the apparatus main body. Then, a sheet discharging instruction can be issued by obtaining ID information therefrom.

Upon receiving the sheet discharging instruction, the video controller 502 issues the sheet discharging instruction to the image forming apparatus CPU 503. The image forming apparatus CPU 503 controls the actuator to move the extrusion unit 233 from the stacking position to the extruding position.

In this case, information about the user who has instructed printing of the sheet stored in the sheet storage unit has been stored in a storage unit. In other words, since the information about whose job has been stored in which sheet storage unit has been stored in the storage unit, the user is not required to recognize which sheet storage unit has stored the user's job. The user can receive the user's job by issuing the sheet discharging instruction.

Near the discharge openings 234 to 236, a sheet discharge sensor (not illustrated) is disposed as a detection unit configured to detect removal of a sheet bundle B by the user. After the removal of the sheet bundle B has been detected by the sheet discharge sensor, the extrusion unit 233 moves from the extruding position to the stacking position.

Each of the sheet storage units 201 to 203 includes a sheet presence detection unit configured to detect whether any sheet has been stacked in the sheet storage unit. The sheet presence detection units respectively include sheet presence detection flags (rotary members or moving members) 251 to 253 rotatable from home positions by contacting the sheets stored in the sheet storage units 201 to 203, and photosensors 281 to 283 configured to output signals according to positions of the sheet presence detection flags. The control unit 501 deletes sheet storage information by detecting that there is no sheet stacked in the sheet storage units 201 to 203 according to the outputs from the photosensors 281 to 283. Thus, the sheet storage unit can store a new sheet (another job) again.

Next, a configuration of the sheet presence detection unit will be described in detail.

Figure 4:
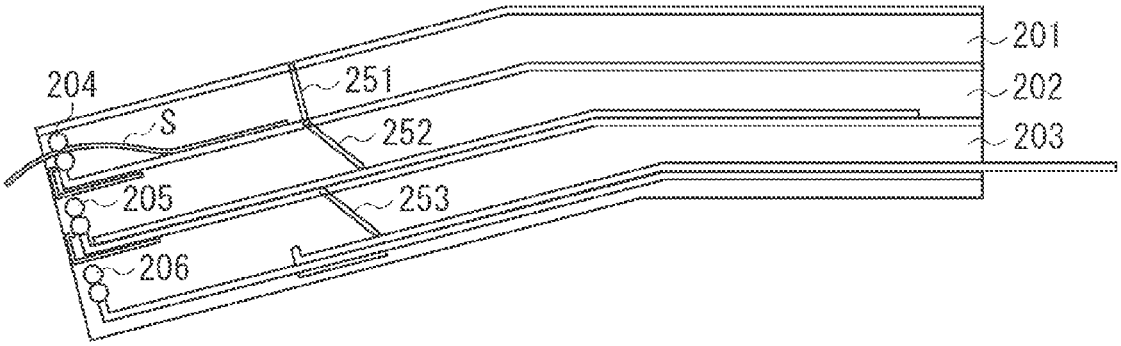
FIG. 4 is a diagram illustrating a sheet presence detection flag according to the first exemplary embodiment of the present invention.
Figure 5A:
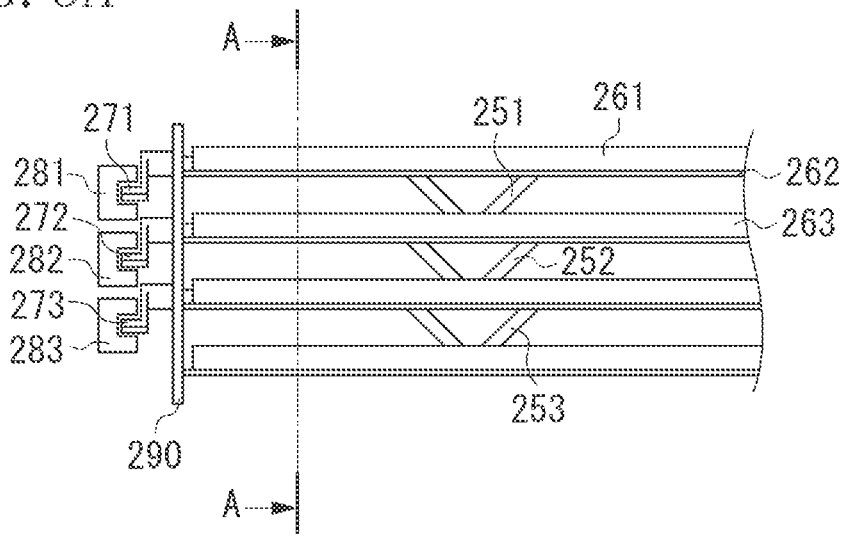
FIGS. 5A to 5C are diagrams illustrating the sheet presence detection flag according to the first exemplary embodiment of the present invention.
Figure 5B:
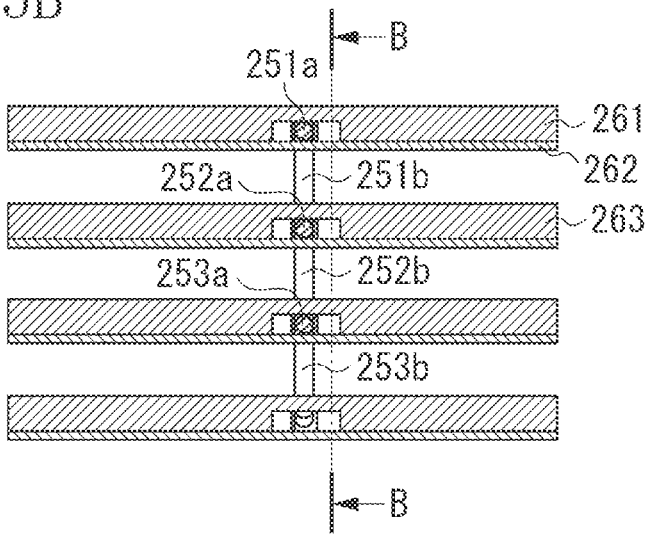
Figure 5C:
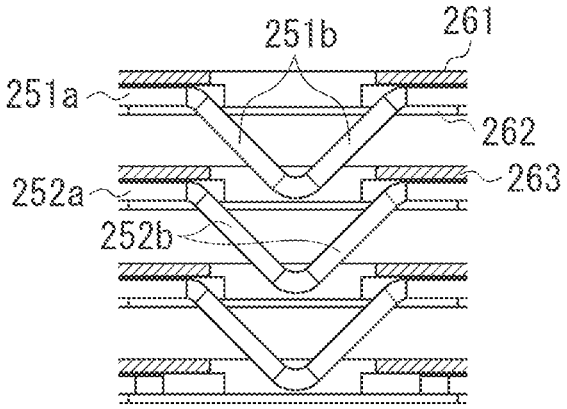
Figure 6:
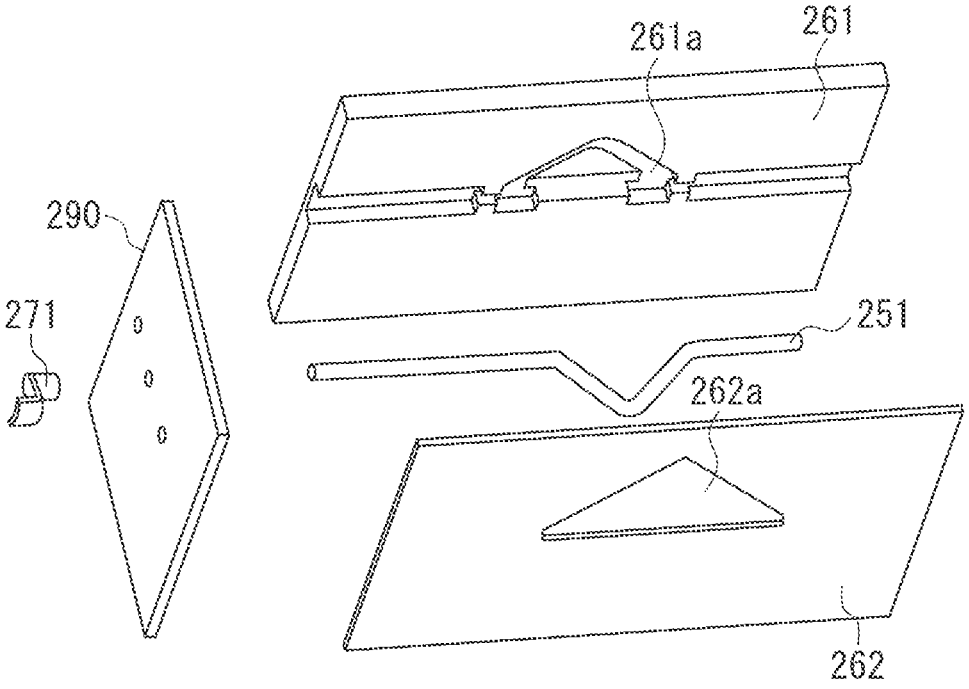
FIG. 6 is a diagram illustrating the sheet presence detection flag according to the first exemplary embodiment of the present invention.

FIG. 4 is an enlarged view illustrating the sheet storage apparatus 200 illustrated in FIGS. 1A and 1B. FIG. 5A is a diagram of the sheet storage unit seen from a sheet discharge opening direction (right direction in FIG. 4), illustrating only a part of the apparatus front side. FIG. 5B is a schematic sectional view taken along the line A-A illustrated in FIG. 5A. FIG. 5C is a sectional view taken along the line B-B illustrated in FIG. 5B. FIG. 6 is a perspective view illustrating developed peripheral components of the sheet presence detection flag. The sheet storage apparatus 200 has a front plate 290.

The sheet presence detection flags 252 and 253 are similar in configuration to the sheet presence detection flag 251, and thus the sheet presence detection flag 251 will be mainly described below. The sheet presence detection flag 251 made of one wire material as illustrated in FIG. 6. The sheet presence detection flag 251 is disposed to be rotatable around a rotational axis 251*a* extending in a direction orthogonal and horizontal to a sheet conveying direction. The sheet presence detection flag 251 includes a flag portion (abutting portion) 251*b* abutted on the sheet. The flag portion 251*b* is disposed at a position overlapping an end of a sheet of a smallest size stored in the sheet storage unit in a sheet width direction.

In the present exemplary embodiment, the flag portion 251*b* has a triangular shape (bent portion) formed by bending the wire material. The sheet presence detection flag 251 is held by a first support member 261 and a second support member 262 in a vertical direction and the sheet conveying direction. Since the rotational axis 251*a* of the sheet presence detection flag 251 is sandwiched between the first support member 261 and the second support member 262 to be included therebetween, the sheet is not stuck on the rotational axis 251*a* during conveying.

Figure 7:
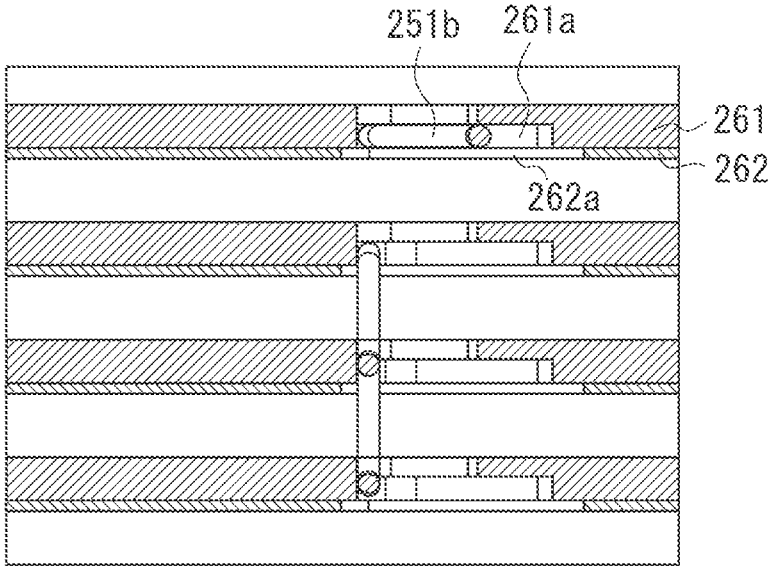
FIG. 7 is a diagram illustrating the sheet presence detection flag according to the first exemplary embodiment of the present invention.

The first support member 261 includes a notch 261*a* that can store the flag portion 251*b*. Similarly, the second support member 262 includes a notch 262*a*. FIG. 7 is a sectional view taken across a vertex of the triangular shape of the flag portion 251*b* in a state where the sheet presence detection flag 251 is rotated to a maximum. By configuring the flag portion 251*b* in such a storable manner, even when a storage space is narrow in a sheet thickness direction, more sheets can be stored.

As illustrated in FIGS. 5A, 5B, and 5C, and FIG. 6, a sensor light shielding unit 271 is integrally attached to one end of the sheet presence detection flag 251. When the sheet presence detection flag 251 rotates, the sensor light shielding unit 271 integrally rotates and moves. In the sheet storage unit 201, the photosensor 281 is provided over the sensor light shielding unit 271. In a state in which the photosensor 281 is shielded from light, the photosensor 281 detects that no sheets are stored in the sheet storage unit 201. On the other hand, when the photosensor 281 is in a light-transmitting state, the photosensor 281 detects that sheets are stored in the sheet storage unit 201.

The sheet presence detection flag 251 receives a force applied by self-weight of the sheet presence detection flag 251 and self-weight of the sensor light shielding unit 271 to rotate in a clockwise direction in FIG. 4. A vertex of the flag portion 251*b* abuts on the support member 263 to determine a home position of the sheet presence detection flag 251 when no sheets are stored in the sheet storage unit 201. Needless to say, in addition to the self-weight of the sheet presence detection flag 251 and the self-weight of the sensor light shielding unit 271, by adding a spring, the sheet presence detection flag 251 may be regulated to the home position of the sheet presence detection flag 251 when no sheets are stored in the sheet storage unit 201.

Next, a most characteristic configuration of the present exemplary embodiment will be described with reference to FIG. 5C. In a vertical direction in FIG. 5C, the vertex of the flag portion 251*b* of the sheet presence detection flag 251 overlaps the support member 263 of the lower adjacent sheet storage unit 202. With this configuration, in the case where there is no sheet stored in the sheet storage unit 201, the sheet can be prevented from slipping through between the sheet presence detection flag 251 and the support member 263 when the sheet is conveyed to the sheet storage unit 201. Further, in the vertical direction in FIG. 5C, the vertex of the flag portion 251*b* overlaps the rotational axis 252*a* of the sheet presence detection flag 252. By entering the vertex of the flag portion 251*b* into a space at the bottom of the triangular shape of the flag portion 252*b* of the sheet presence detection flag 252, overlapping of the vertex of the flag portion 251*b* and the rotational axis 252*a* of the sheet presence detection flag 252 is realized. The sheet presence detection flag 251 and the adjacent sheet presence detection flag 252 can independently move irrespective of a mutual positional relationship without interfering with each other on their rotational loci.

The sheet presence detection flag 251 has been mainly described above. The sheet presence detection flags 252 and 253 and the respective flag portions 252*b* and 253*b* are similar in configuration to the sheet presence detection flag 251 and the flag portion 251*b*.

Finally, an operation of the sheet presence detection unit will be described. In FIG. 4, the sheet presence detection flag 251 is illustrated as it is at the home position thereof. In this case, the sensor light shielding unit 271 shields the photosensor 281 from light. In other words, the control unit detects that there is no sheet in the sheet storage unit 201. When the sheet S is further conveyed from the position illustrated in FIG. 4 by the conveyance roller 204, the leading end of the sheet S is brought into contact with the flag portion 251*b* of the sheet presence detection flag 251, and the sheet S is stored while rotating the sheet presence detection flag 251 counterclockwise.

The sheet storage unit 202 is illustrated as in a state where a sheet has been stored therein. The sheet presence detection flag 252 is riding on the stored sheet. At this time, the photosensor 282 that detects a state of the sheet presence detection flag 252 is in a light transmitting state. In other words, the control unit detects that there is a sheet in the sheet storage unit 202.

The sheet storage unit 203 is illustrated as in a state where the leading end of the sheet is being discharged from the discharge opening. In the state illustrated in FIG. 4, the photosensor 283 that detects a state of the sheet presence detection flag 253 is in a light transmitting state. When the user removes the sheet in this state, the sheet presence detection flag 253 rotates clockwise to move to its home position, the photosensor 283 switches to a light shielding state, and the control unit detects a no-sheet state.

As described above, according to the present exemplary embodiment, the sheet storage apparatus that includes the plurality of stages of vertically stacked sheet storage units can be reduced in size in the height direction.

More specifically, the vertex of the flag portion 251*b* overlaps the support member 263 serving also as a lower guide to guide a lower surface of the sheet stored in the sheet storage unit 201, and the rotational axis 252*a* of the adjacent sheet presence detection flag. With this configuration, the first support member 261 and the second support member 262 can be thinned as much as possible, while preventing the sheet from slipping therethrough. Thus, the sheet storage apparatus can be miniaturized while a sheet storage space can be secured in the height direction. The support member 262 also functions as an upper guide to guide the upper surface of the sheet stored in the sheet storage unit 201.

Further, adopting the configuration of the present exemplary embodiment enables a positional relationship between the sheet conveyance unit and the sheet presence detection flag to be similar among the sheet storage units. This provides an effect of communalizing the components of each storage unit. Examples of components to be shared include the sheet conveyance unit, the sheet presence detection flag, the sensor light shielding unit, the support member, and the sheet discharging unit.

Further, according to the present exemplary embodiment, the strength of the sheet presence detection flag 251 made of the wire material can be increased by sandwiching the sheet presence detection flag 251 between the support member 262 and the support member 261. Since the sheet presence detection flag 251 is not subject to application of strong strength thereto, it can be made of a wire material. However, the present invention should not be limited to the formation of the sheet presence detection flag 251 by the wire material. The sheet presence detection flag can be made of a molded component or the like.

Further, tinning of the sheet storage apparatus is achieved by disposing the photosensor and the sensor light shielding unit outside (outside sheet storage area) of the sheet conveyance path in the width direction.

If the sheet storage apparatus can be thinned, the number of sheet storage units arranged in the image forming apparatus main body can be increased while suppressing the height of the entire apparatus.

Hereinafter, a second exemplary embodiment of the present invention will be described with reference to the drawings. In the first exemplary embodiment, the configuration where the shape of the flag portion 251*b* of the sheet presence detection flag 251 is triangular has been described. However, in the present exemplary embodiment, the shape of the flag portion 251*b* is not limited to the triangular shape. Flag portions with other shapes can provide the same effects as those of the first exemplary embodiment. Basically, as long as the shape of the flag portion 251*b* is tapered more away from the rotational axis 251*a* of the sheet presence detection flag, the same effects as those of the first exemplary embodiment can be provided.

Figure 8A:
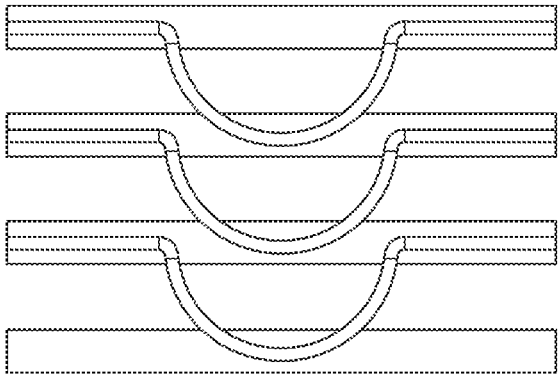
FIGS. 8A and 8B are diagrams illustrating a sheet presence detection flag according to a second exemplary embodiment of the present invention.
Figure 8B:
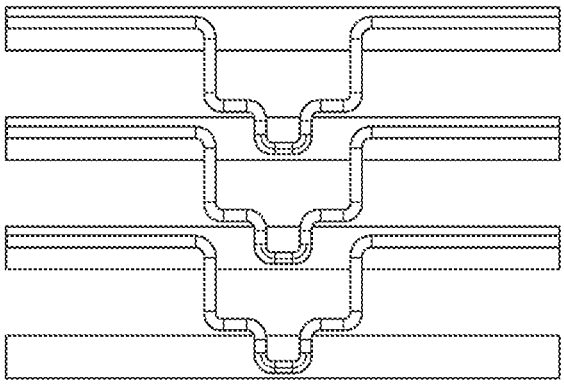

FIGS. 8A and 8B illustrate a configuration example of a flag portion according to the second exemplary embodiment. FIGS. 8A and 8B are diagrams illustrating a flag portion of a sheet presence detection flag seen from a sheet discharging direction. In FIGS. 8A and 8B, a support member is illustrated in a simplified manner. In reality, the support member is similar in configuration to that of the first exemplary embodiment. FIG. 8A illustrates an example where the flag portion is formed into a circular-arc shape. FIG. 8B illustrates an example where the flag portion is formed into a stepped shape.

Hereinafter, a third exemplary embodiment of the present invention will be described with reference to the drawings. In the first exemplary embodiment and the second exemplary embodiment, the configuration where the shapes of the flag portions of the sheet presence detection flags included in the sheet storage units are similar has been described. However, the present invention is not limited to this configuration. As long as flag portions of sheet presence detection flags have shapes similar to those illustrated in FIG. 9, even when the shapes of the flag portions of the sheet presence detection flags are different among the sheet storage units, the same effects as those of the first exemplary embodiment can be provided.

Figure 9:
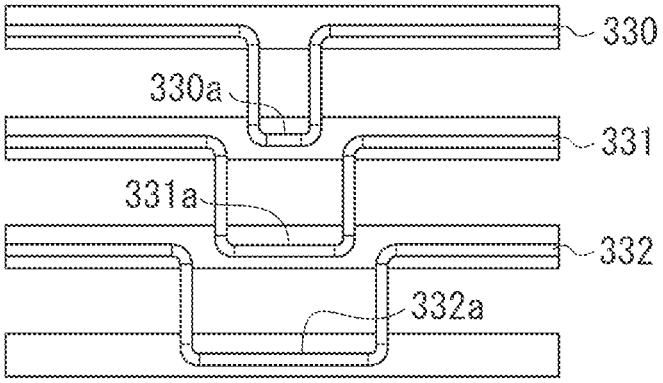
FIG. 9 is a diagram illustrating a sheet presence detection flag according to a third exemplary embodiment of the present invention.

FIG. 9 illustrates flag portions of sheet presence detection flags according to the third exemplary embodiment. As in the case of FIGS. 8A and 8B, a support member is illustrated in a simplified manner.

As illustrated in FIG. 9, according to the third exemplary embodiment, shapes of the flag portions of sheet presence detection flags 330, 331, and 332 are different from one another. In a rotational axis direction of the sheet presence detection flag, a length (width) of a flag portion 331*a* of the sheet presence detection flag 331 is larger than that of a flag portion 330*a* of the sheet presence detection flag 330, and a protruded portion of the flag portion 330*a* enters into a depressed portion of the flag portion 331*a* that forms the flag portion 331*a*. In other words, the protruded portion of the flag portion 330*a* overlaps a rotational axis of the sheet presence detection flag 331. A length (width) of a flag portion 332*a* of the sheet presence detection flag 332 is further (gradually) larger than that of the flag portion 331*a*, and a protruded portion of the flag portion 331*a* enters into a depressed portion of the flag portion 332*a*. As described above in the first exemplary embodiment, the protruded portion of the flag portion 330*a* overlaps the rotational axis of the sheet presence detection flag 331 in the rotational axis direction of the rotational axis.

According to the first to third exemplary embodiments described above, at least a part of the rotary member overlaps, at the home position (contact position), the rotational axis of the rotary member of the adjacent sheet storage unit in the vertical direction. Thus, the sheet storage unit can be designed to be thin, and the sheet storage apparatus can be miniaturized in the height direction. Further, the components can be communalized among the sheet storage units.

Further, according to the first to third exemplary embodiments, a rotational supporting point of the sheet presence detection flag is arranged in the upper guide (support member) of each sheet storage unit. This is for a reason below. Since the self-weight of the sheet presence detection flag is applied in a direction for holding the flag itself at the home position by arranging the rotational supporting point of the sheet presence detection flag on the upper side, a spring force for pressing the sheet presence detection flag can be set low. As described above in the exemplary embodiments, no spring may be necessary depending on a design of the apparatus.

However, in the present invention, the rotational supporting point of each sheet presence detection flag may be arranged in the lower guide of each sheet storage unit. In other words, the sheet presence detection flag as the rotary member may be disposed in one of the lower and upper guides, and formed to be tapered toward the other side.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-083186 filed Apr. 14, 2014, which is hereby incorporated by reference herein in its entirety.

What is claimed is:

1. A sheet storage apparatus comprising:

a first sheet storage unit and a second sheet storage unit which are stacked in a vertical direction and configured to store a sheet conveyed by the sheet conveyance unit, each of the first sheet storage unit and the second sheet storage unit including:

a lower guide configured to guide a lower surface of the sheet conveyed by the sheet conveyance unit;

an upper guide configured to guide an upper surface of the sheet conveyed by the sheet conveyance unit;

a rotary member disposed in one of the lower guide and the upper guide, and configured to rotate from a home position around a rotational axis extending in a direction orthogonal to a sheet conveying direction by contacting the sheet conveyed by the sheet conveyance unit;

a sensor configured to output a signal according to a position of the rotary member; and a control unit configured to detect presence of a sheet stored in each of the first sheet storage unit and the second sheet storage unit according to an output of each sensor, wherein, in a case where a first rotary member included in the first sheet storage unit is at the home position, at least a part of the first rotary member, viewed from a downstream side in the sheet conveying direction, overlaps a virtual line extending in the direction orthogonal to the sheet conveying direction and passing through a rotational axis of a second rotary member included in the second sheet storage unit.

2. The sheet storage apparatus according to claim 1, wherein at least one of the lower guide and the upper guide included in the first sheet storage unit has a first notch into which the first rotary member is able to enter.

3. The sheet storage apparatus according to claim 2, wherein at least one of the lower guide and the upper guide included in the second sheet storage unit has a second notch into which the second rotary member is able to enter, wherein a size of the first notch is different from a size of the second notch.

4. The sheet storage apparatus according to claim 1, wherein, viewed from the downstream side in the sheet conveying direction, the first rotary member is tapered from the rotational axis of the first rotary member toward a protruded portion of the first rotary member.

5. The sheet storage apparatus according to claim 1, further comprising an extrusion unit configured to extrude at least a part of the sheet stored in each of the sheet storage unit out of each of the sheet storage unit.

6. The sheet storage apparatus according to claim 1, wherein the first rotary member includes a bent wire member.

7. A sheet storage apparatus comprising:

a sheet storage unit configured to store a sheet conveyed by a sheet conveyance unit, wherein the sheet storage unit includes:

a first surface on which the sheet conveyed by the sheet conveyance unit is stacked;

a second surface facing the first surface;

a moving member protruding from one of the first surface and the second surface to the other of the first surface and the second surface and configured to move from a home position by contacting the sheet conveyed by the sheet conveyance unit;

a sensor configured to output a signal according to a position of the moving member; and an extrusion unit configured to extrude at least a part of the sheet stacked on the first surface out of the sheet storage unit, wherein, in a case where the moving member is at the home position, at least a part of the moving member overlaps a virtual plane passing through the other of the first surface and the second surface.

8. The sheet storage apparatus according to claim 7, wherein the moving member rotates from the home position by contacting the sheet conveyed by the sheet conveyance unit.

9. The sheet storage apparatus according to claim 7, wherein the moving member includes a bent wire member.

10. The sheet storage apparatus according to claim 7, further comprising a plurality of the sheet storage units which are stacked in a vertical direction.

11. The sheet storage apparatus according to claim 7, further comprising a control unit configured to determine whether a sheet is stored in the sheet storage unit according to an output of the sensor.

12. The sheet storage apparatus according to claim 7, wherein at least one of the first surface and the second surface has a notch into which the rotary member is able to enter.

13. An image forming apparatus comprising:

an image forming unit configured to form an image on a sheet;

a sheet conveyance unit configured to convey the sheet on which an image has been formed by the image forming unit;

a first sheet storage unit and a second sheet storage unit which are stacked in a vertical direction and configured to store the sheet conveyed by the sheet conveyance unit, each of the first sheet storage unit and the second sheet storage unit including:

a lower guide configured to guide a lower surface of the sheet conveyed by the sheet conveyance unit;

an upper guide configured to guide an upper surface of the sheet conveyed by the sheet conveyance unit;

a rotary member disposed in one of the lower guide and the upper guide, and configured to rotate from a home position around a rotational axis extending in a direction orthogonal to a sheet conveying direction by contacting the sheet conveyed by the sheet conveyance unit;

a sensor configured to output a signal according to a position of the rotary member; and a control unit configured to detect presence of a sheet stored in each of the first sheet storage unit and the second sheet storage unit according to an output of each of the sensors, wherein, in a case where a first rotary member included in the first sheet storage unit is at the home position, at least a part of the first rotary member, viewed from a downstream side in the sheet conveying direction, overlaps a virtual line extending in the direction orthogonal to the sheet conveying direction and passing through a rotational axis of a second rotary member included in the second sheet storage unit.

14. An image forming apparatus comprising:

an image forming unit configured to form an image on a sheet;

a sheet conveyance unit configured to convey the sheet on which an image has been formed by the image forming unit;

a sheet storage unit configured to store the sheet conveyed by the sheet conveyance unit, wherein the sheet storage unit includes;

a first surface on which the sheet conveyed by the sheet conveyance unit is stacked;

a second surface facing the first surface;

a moving member protruding from one of the first surface and the second surface to the other of the first surface and the second surface and configured to move from a home position by contacting the sheet conveyed by the sheet conveyance unit;

a sensor configured to output a signal according to a position of the moving member; and an extrusion unit configured to extrude at least a part of the sheet stacked on the first surface out of the sheet storage unit, wherein, in a case where the moving member is at the home position, at least a part of the moving member overlaps a virtual plane passing through the other of the first surface and the second surface.

* * * * *